US011041681B2

(12) United States Patent
Wanni

(10) Patent No.: US 11,041,681 B2
(45) Date of Patent: Jun. 22, 2021

(54) CLAMPING SYSTEM FOR A TUBE IN A TUBE BUNDLE

(71) Applicant: Amar S. Wanni, Fairfax, VA (US)

(72) Inventor: Amar S. Wanni, Fairfax, VA (US)

( * ) Notice: Subject to any disclaimer, the term of this patent is extended or adjusted under 35 U.S.C. 154(b) by 120 days.

(21) Appl. No.: 16/664,908

(22) Filed: Oct. 27, 2019

(65) Prior Publication Data

US 2021/0123694 A1 Apr. 29, 2021

(51) Int. Cl.
*F28F 9/013* (2006.01)

(52) U.S. Cl.
CPC ..... *F28F 9/013* (2013.01); *F28F 2265/30* (2013.01)

(58) Field of Classification Search
CPC ..... F28F 9/013; F28F 9/0132; F28F 9/0138; F28F 2265/30; F16L 3/10; F16L 3/1033; F16L 3/1075; F16L 3/1083; F16L 3/237
See application file for complete search history.

(56) References Cited

U.S. PATENT DOCUMENTS 3,232,569 A * 2/1966 Deardorf ..... F16L 3/221 248/74.1
3,544,049 A * 12/1970 Ribble ..... F16L 3/23 248/68.1
4,088,184 A 5/1978 Cavallaro
4,648,442 A 3/1987 Williams
4,789,028 A 12/1988 Gowda et al.
4,848,452 A * 7/1989 McDonald ..... F22B 37/203 165/178
5,515,911 A 5/1996 Boula et al.
7,032,655 B2 4/2006 Wanni et al.
7,073,575 B2 7/2006 Wanni et al.
7,128,130 B2 10/2006 Wanni et al.
7,219,718 B2 5/2007 Wanni et al.
7,267,164 B2 9/2007 Wanni et al.
7,343,964 B2 3/2008 Rudy et al.
7,699,093 B2 4/2010 Wanni et al.
7,793,708 B2 9/2010 Wanni et al.
9,488,419 B2 11/2016 Wanni
9,958,217 B1 * 5/2018 Oakes ..... F22B 37/101
10,077,677 B2 * 9/2018 Prestel ..... F01D 11/24

* cited by examiner

*Primary Examiner* — Eric S Ruppert
(74) *Attorney, Agent, or Firm* — Louis Ventre, Jr.

(57) ABSTRACT

A clamping system secures to at least one tube in a tube bundle of a heat exchanger in order to reduce vibration damage. The clamping system includes a first clamping component having a J-shape, a second clamping component having an L-shape, a configuration where the first arc around the tube plus the second arc around the tube is equal to at least 100 degrees; and a means for resisting movement of the clamping components. The first clamping component with a J-shape covers a first arc around the tube. The second clamping component with an L-shape covers a second arc opposite the first arc. One of the means for resisting movement includes a stake, a nut, and a bolt.

16 Claims, 12 Drawing Sheets

CLAMPING SYSTEM FOR A TUBE IN A TUBE BUNDLE

TECHNICAL FIELD

In the field of heat exchange, a clamping system that securely fastens to one or more tubes in a heat exchanger to prevent damaging movement of the tubes within the tube bundle and to improve the performance of the vibration limiting attachments in minimizing damage to the tubes.

BACKGROUND ART

Tube bundles are typically used in shell-and-tube heat exchangers where the tubes, often a tube bundle, contain fluid flow of one temperature and surrounding fluid flow outside of the tubes (also referred to as the "shell side") is at another temperature, which then enables heating or cooling of the different fluid flows due to contact with the external tube surfaces.

Fluid flow patterns around the tubes often gives rise to flow-induced vibrations of an organized or random oscillatory nature. Such vibration is known to damage the tubes so that solutions that minimize tube vibration are sought after.

Fastening rows of tubes together can be accomplished by mechanically connecting two or more rows of tubes. In one example, one or more stakes are inserted between columns formed by rows of tubes in a tube bundle often press against the external tube walls and the interference between the stake and the tube walls creates frictional-surface contact between the stake and the tubes. Preferably, the thickness of the stake is slightly greater than the lane width so that the tubes are slightly warped as well thereby increasing stiffness of the tubes that will also add to vibration mitigation. These columns are sometimes referred to as "lanes" because they extend from top to bottom of a tube set, from left to right in a tube bundle, or at any angle in-between in a tube bundle. The frictional-surface contact between the stake and the tubes provides additional tube support and thereby diminishes tube vibration.

A stake may have one or more protrusions that are intended to engage the surface of a tube and hold the stake and the tube in place. Alternatively, a stake may be softer than the tube so that it compresses against the tubes to hold it in place against the tubes. Finally, a stake may have periodic curved "saddles" that rest against each tube in the lane in a more stable engagement that resists movement of both the stake and the tubes.

SUMMARY OF INVENTION

A clamping system secures to at least one tube in a tube bundle of a heat exchanger in order to reduce vibration damage. The clamping system includes a first clamping component having a J-shape, a second clamping component having an L-shape, and a means for resisting movement of the clamping components.

The first clamping component with a J-shape covers a first arc around a tube in the tube bundle greater than 10 degrees of the tube. The straight part of the J-shape defines a first aperture. The curved part of the J-shape may be configured to define first fingers made flexible by one or more first cuts defined within the lower curved part of the J-shape.

The second clamping component with an L-shape covers a second arc opposite the first arc greater than 10 degrees of the tube. The vertical-leg segment of the L-shape fits against the straight part of the J-shape and defines a second aperture that aligns with the first aperture. The second arc of the L-shape may be configured to define second fingers made flexible by one or more second cuts within the horizontal-leg segment of the L-shape.

The first arc around the tube plus the second arc around the tube is equal to at least 100 degrees.

The means for resisting movement may include a stake defining a third aperture; a nut; and a bolt. The bolt is configured to fit through the first aperture, the second aperture and the third aperture when the first aperture, the second aperture and the third aperture are placed in alignment.

The means for resisting movement may include a stake and a self-tapping screw to pierce the stake to secure the first clamping component and a second clamping component to the stake.

The means for resisting movement may include at least two stakes fitting in different lanes of the tube bundle and two clamp sets that are joined together with at least three nuts and a long bolt.

The means for resisting movement may include a stake configured with an elongated channel and having a planar side and an open side with two extensions. The stake defines a third aperture. This means for resisting movement includes a bolt that fits through aligned apertures and a nut that is threadably attachable to the bolt.

The clamping system may include a flexible washer having a thickness within a range of 0.2 to 3 millimeters, and configured to occupy a position between the second clamping component and the first clamping component.

Technical Problem

Heat exchangers have tube bundles that are vulnerable to vibration damage as fluids flow within the tubes and external to the tubes in the tube bundle. The external flow is considered to be the greater contributor to vibration damage. When the tube side has a liquid, the tube resists vibration a little more than if it is gas owing to increased dampening from the denser liquid flow. The U-bend region of a tube bundle is often the most vulnerable position involving stake retention problems.

Typically, for newly manufactured bundles, metal bars are used in initial fabrication. The metal bars have a series of half-holes at two edges to partially engage with the walls of the tubes; then these bars are welded together. This approach is not considered practical for an existing bundle. However, this design is used currently during new bundle fabrication as a vibration mitigation step, or simply for structural reasons even when vibration damage is highly unlikely or for both reasons.

A typical solution in older tube bundles has been to use a stake wedged in between columns of tubes and perhaps held in place with protrusions from the stake. The use of a stake wedged in a lane of tubing in a tube bundle is known to mitigate tube damage due to vibrations that are inherent in using tube bundles carrying a fluid. However, the stakes are known to loosen or shift before, during and after use to cause damage.

The typical solution of using a stake has been known to fail. Aside from vibration causing the stake to be displaced from its installed position, damage can occur when a stake is dislodged during bundle installation, operation, cleaning, or other handling and movement of the heat exchanger. If the stake becomes displaced or dislodged and then gets stuck in a nozzle, or even in other equipment downstream, it can be difficult to remove and could result in equipment damage.

Solution to Problem

The solution is an improved clamping system with or without a stake within the tube bundle that can increase vibration-dampening performance. When used without a stake, the clamping system physically locks adjacent tubes together to prevent vibration damage.

When used with a stake, the clamping system can prevent displacement, pivoting or shifting of the stake. The combination of a clamping system and stake can thereby minimize damage to the heat exchanger, the tubes that make up the heat exchanger and the downstream equipment.

When used with a stake configured with a channel, the J-shape clamp component can be configured to fit within the channel and thereby provide an additional physical impediment to pivoting of the stake.

This clamping system is particularly suitable for stabilizing tubes in the U-bend regions of U-tube bundles because when combined with a stake in this area, it provides a mechanical connection between the stake and the tube bundle that physically resists movement of the stake.

Detailed vibration analysis indicates that the clamping system in combination with a stake can potentially eliminate or at the very least drastically reduce tube damage, heat exchanger damage and downstream equipment damage.

Advantageous Effects of Invention

The clamping system provides a positive mechanical engagement of the clamps with two or more tubes, increasing overall stiffness of tubes in the tube bundle. Multiple clamps can be used throughout the tube bundle to improve vibration resistance.

Since the clamps can be physically attached to a stake, the clamping system provides a mechanical connection that secures the tubes to the stake. Thus, the clamping system ensures positional integrity of the stake within the tube bundle and better resists damage from highly dynamic conditions created during operation of the heat exchanger as well as during bundle installation, cleaning, or other handling and movement.

With or without a stake, a positive mechanical engagement ensures reduced tube vibration.

A significant advantage of the disclosed clamping system is that the first clamping component and the second clamping component can be manufactured by an extrusion process.

BRIEF DESCRIPTION OF DRAWINGS

The drawings illustrate preferred embodiments of the clamping system for a tube in a tube bundle according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the clamping system for a tube in a tube bundle. The drawings are presented with the understanding that the present invention is susceptible of embodiments in many different forms and, therefore, other embodiments may be utilized and structural, and operational changes may be made, without departing from the scope of the present invention.

The use herein of a numerical "first" or "second" modifier for a component is not intended to designate a position order or a numerical valuation, but rather is intended only to provide a different name to distinguish or identify a similar but different component for purposes of assisting with the explanation of the invention. Also, the designations horizontal and vertical are intended to describe the component in one particular orientation as perhaps illustrated in the figures, but these designations are not intended to require that orientation nor to exclude rotation of the component so that the component is no longer horizontal or vertical. In this sense, the designations horizontal and vertical are intended to describe the components in order to distinguish them over similar components described herein.

Figure 1A:
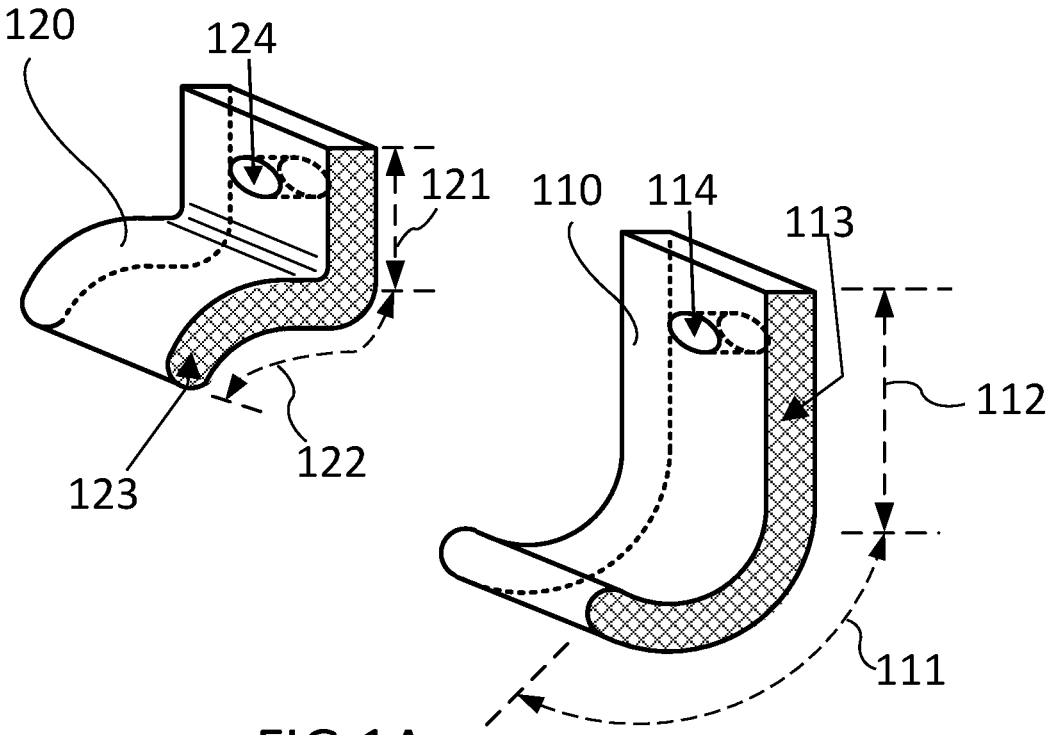
FIG. 1A is a top perspective view of the first clamping component in a J-shape and the second clamping component in an L-shape.

FIG. 1A is a top perspective view of a preferred embodiment of the first clamping component (110) in a J-shape (113) and the second clamping component (120) in an L-shape (123) that make up part of this preferred embodiment of the clamping system for a tube (130) in a tube bundle (320). The remaining component in the clamping system for a tube (130) in a tube bundle (320) is a means for resisting movement of the first clamping component (110) and the second clamping component (120) once the second clamping component (120) is placed against the first clamping component (110) with the tube (130) between the first clamping component (110) and the second clamping component (120). The first clamping component (110) and the second clamping component (120) may be referred to herein as the two clamping components.

Preferably, and as can be envisioned from FIG. 1A, the two clamping components have rectangular cross-section. When manufacturing the two clamping components, they should preferably be configured so that all edges that may come in contact with the tube (130) be rounded in order to avoid tube (130) damage.

Figure 1B:
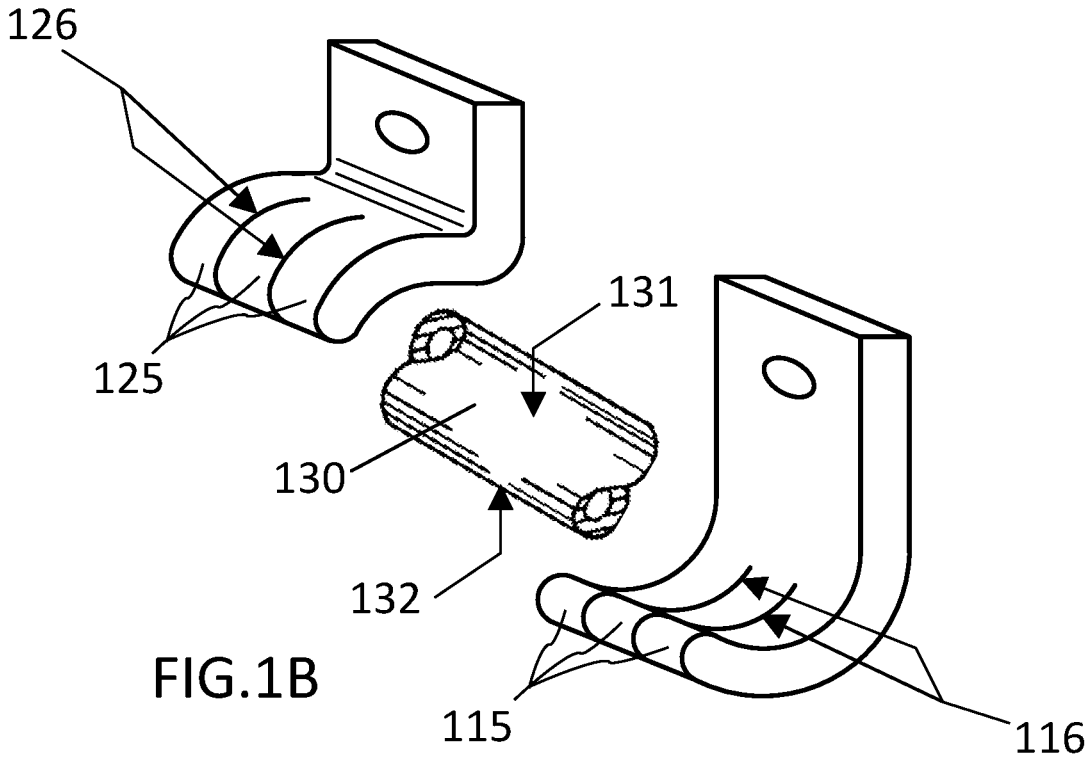
FIG. 1B is a top perspective view of the first clamping component in a J-shape and the second clamping component in an L-shape both configured with fingers and showing a tube in context.

FIG. 1B is a top perspective view in an alternate preferred embodiment having cuts or slits in the curved sections of the J-shape (113) and the L-shape (123). FIG. 1B also shows the relative positions of the components with respect to a tube (130) that would in actual use be within a tube bundle (320) of a heat exchanger. For this alternate embodiment, there is at least one cut in each curved section. When multiple cuts are used to create three or more fingers in the J-shape, the multiple cuts are referred to as first cuts (116) and when multiple cuts are defined to create three or more fingers in the L-shape, the multiple cuts in the L-shape are referred to as second cuts (126). The cuts create fingers that can independently flex when the components are tightened together on the tube (130). The fingers, especially on the second clamping component (120) with the L-shape (123), may be more easily manipulated to conform to the tube shape and this would help ensure greater surface contact or engagement with the tube (130), for example, when the tube (130) has curvatures in two directions. The fingers shown in the J-shape are referred to as first fingers (115) and those shown in the L-shape are referred to as second fingers (125).

In some embodiments there may be two or more first fingers (115) and no second fingers (125), or two or more second fingers (125) and no first fingers (115), or two or more first fingers (115) and second fingers (125) may be present.

For example, in one exemplary embodiment, the lower curved part (111) of the J-shape (113) is further configured to define first fingers (115) made flexible by at least two of the first cuts (116) defined within the lower curved part (111) of the J-shape (113).

In a second exemplary embodiment, the horizontal-leg segment (122) of the L-shape (123) is further configured to define second fingers (125) made flexible by at least two of the second cuts (126) defined within the horizontal-leg segment (122) of the L-shape (123).

And in a third exemplary embodiment, both the lower curved part (111) of the J-shape (113) and the horizontal-leg segment (122) of the L-shape (123) are configured with one and more cuts to define fingers.

As shown in FIG. 1A and FIG. 1B, the first clamping component (110) is configured with a J-shape (113). The "J-shape" is a creative term that generally describes shape of the component when in a vertical orientation and viewed from the right side as in FIG. 1A where the J-shape (113) is readily identified by the cross-hatched area. When in use and oriented in a slanted or upside down configuration, the J-shape (113) may not be so readily identified.

As with the letter "J", the J-shape (113) of the first clamping component (110) includes a lower curved part (111) and a straight part (112). In a preferred embodiment shown in FIG. 2, the lower curved part (111) of the J-shape (113) is configured to occupy a first arc (210) around a segment of the tube (130) exemplified in FIG. 2 as occupying arc at a bottom (132) of the tube (130) in the tube bundle (320). The term "bottom" is only used for ease of description and should not be interpreted to require only application to the bottom of the tube (130), but rather the contact might be different. For example, when the means for resisting movement comprises a stake (330), then the stake (330) may be inserted at an angle into a lane in the tube bundle (320). Another example is when the top and bottom locations are reversed in some installations, so that the lower curved part (111) arcs around the top (131) of the tube (130).

Figure 2:
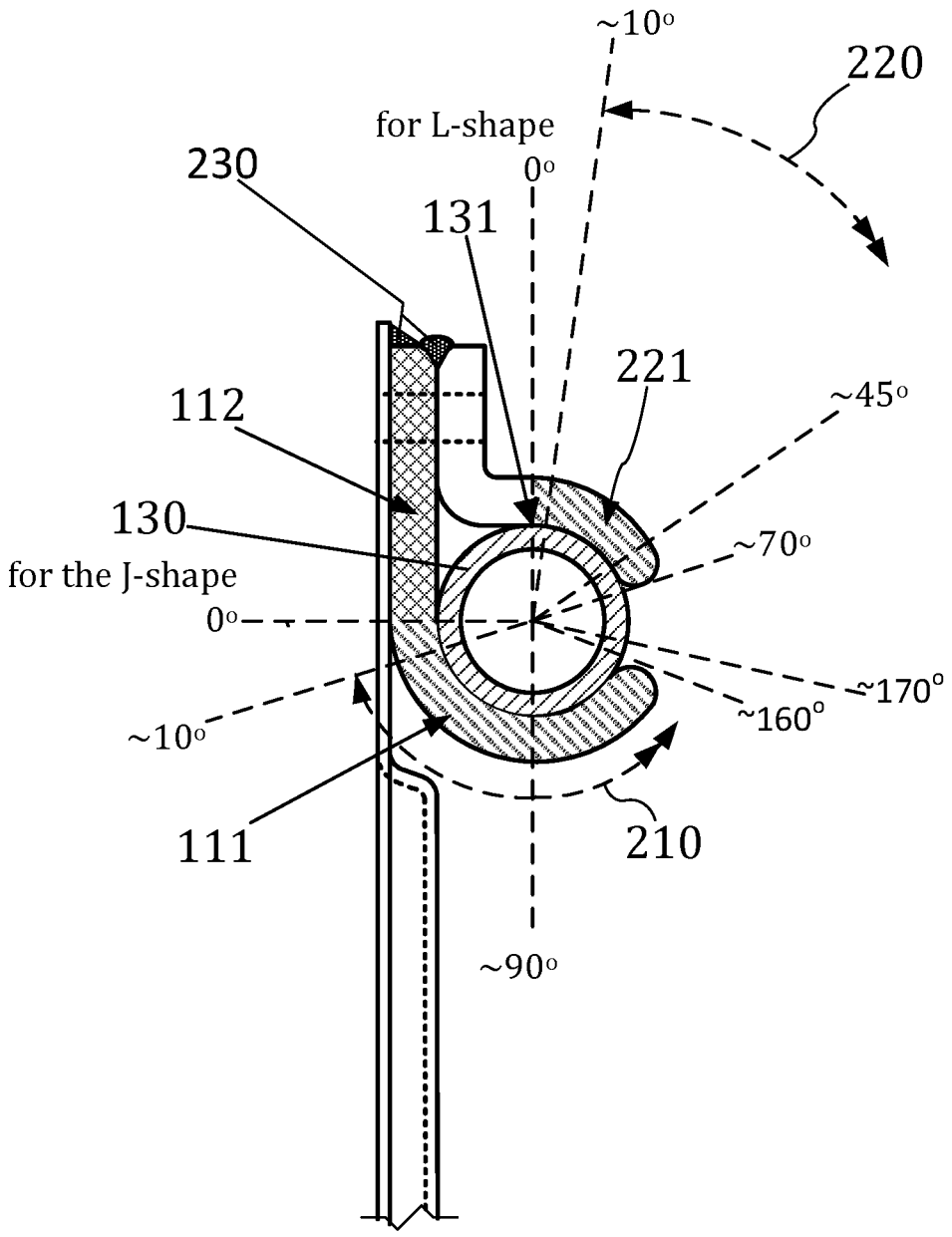
FIG. 2 is an elevation view thereof an assembled clamping system showing arc lengths for the curved segments of the first clamping component and the second clamping component.

The first arc (210) is preferably defined to be within an arc segment greater than 90 degrees of the tube (130), measured from a horizontal axis to the left in FIG. 2. Functionality would still remain with minus 10 degrees from this 90 degree preferable arc segment. The designated arc segment provides sufficient engagement between the first clamping component (110) and the tube (130) upon installation. An arc segment range is defined to be a portion or arc range of the circumference of the tube (130). In a preferred embodiment, the first arc (210) is greater than about 10 degrees and more preferably is within a range of about 90 to 135 degrees of the tube. The example shown in FIG. 2, the lower curved part (111) of the J-shape (113) is identified by the slanted hatching, and in this example, which is preferable when greater tube engagement is desired to increase the mechanical grip of the clamps, the first arc (210) extends from the 0 degree axis to about 160 degrees of the bottom part of the J-shape (113).

Referring to FIG. 2, the clamping system is preferably configured so that the first arc (210) is constrained to be greater than 10 degrees of the tube (130). Functionality involving a positive grip of the clamps to the tube (130) is retained with minus 2 degrees of the 10 degrees specified and so, for some applications, the first arc (210) is constrained to be greater than about 10 degrees of the tube (130).

The straight part (112) of the J-shape (113) preferably defines a first aperture (114) through the first clamping component (110). There may be more than one first aperture (114) in applications where more than one bolt (310) and nut (311) is used.

The second clamping component (120) is configured with an L-shape (123). The "L-shape" description is a creative term because that generally describes the shape of the second clamping component (120) when in a vertical orientation and viewed from the left side. As can be seen in FIG. 1A, the L-shape (123) is backwards and the bottom leg of the L-shape (123) starts off being perpendicular to the vertical-leg segment (121), but is mostly curved downward. The L-shape (123) is readily identified by the other cross-hatched area in FIG. 1A. When in use and oriented in a slanted or upside down configuration, the L-shape (123) may not be so readily identified.

The second clamping component (120) includes a horizontal-leg segment (122) and a vertical-leg segment (121). The horizontal-leg segment (122) of the L-shape (123) has a downward-curved section (221) that is configured to occupy a second arc (220) on an arc segment of the tube (130). The second arc (220) is generally opposite to the first arc (210) of the J-shape (113).

In the example shown in FIG. 2, the second arc (220) starts at the top (131) of the tube (130) above the lower curved part (111) of the first clamping component (110).

As shown in FIG. 2, the second arc (220) is defined to be greater than 10 degrees of the tube (130), as measured from the vertical axis at the upper end in FIG. 2. The vertical-leg segment (121) of the L-shape (123) is configured to fit against the straight part (112) of the J-shape (113) of the first clamping component (110), as is shown. In a preferred embodiment, the second arc is constrained to extend to a range of 30 to 75 degrees of the tube. For most applications, a practical set of ranges for arcs of tube contact are the first arc (210) that is constrained to extend to a range of 10 to 135 degrees of the tube (130) and the second arc (220) is constrained to extend to a range of 10 to 135 degrees of the tube (130).

For most embodiments, the minimum arc coverage of the tube (130) by the combination of the first arc (210) and the second arc (220), is determined by an equation: the first arc (210) plus the second arc (220) is equal to or greater than 100 degrees. Theoretically, this minimum arc coverage is about 100 degrees because functionality involving a positive grip of the clamps to the tube (130) is retained with 90 degrees, or 10 degrees less than the 100 degrees specified for most embodiments. Thus, in theory, the minimum of the first arc (210) around the tube (130) plus the second arc (220) around the tube (130) is in a range of 90 to 100 degrees. This minimum arc coverage limitation preferably applies when a single tube is between the first clamping component (110) and the second clamping component (120). When two tubes are involved, such as the two tubes in FIG. 9, the minimum arc coverage applies to the arcs covered by both tubes. For most embodiments where one tube is involved, it is preferable to limit the second arc (220) for the L-shape (123) of the second clamping component (120) to less than about 90 degrees so that the tightening process creates a relative movement between the two curved portions of the clamping components towards each other, thereby squeezing the tube to ensure positional integrity.

Alternatively, when the second arc (220) for the L-shape (123) of the second clamping component (120) exceeds 90 degrees, the tightening process creates a relative movement between the two curved portions of the clamping components where the tube (130) mostly tightens toward the straight part (112) of the J-shape. The lower curved part (111) of the J-shape (113) prevents the clamping system from being ejected out of the tube bundle (320).

Figure 11:
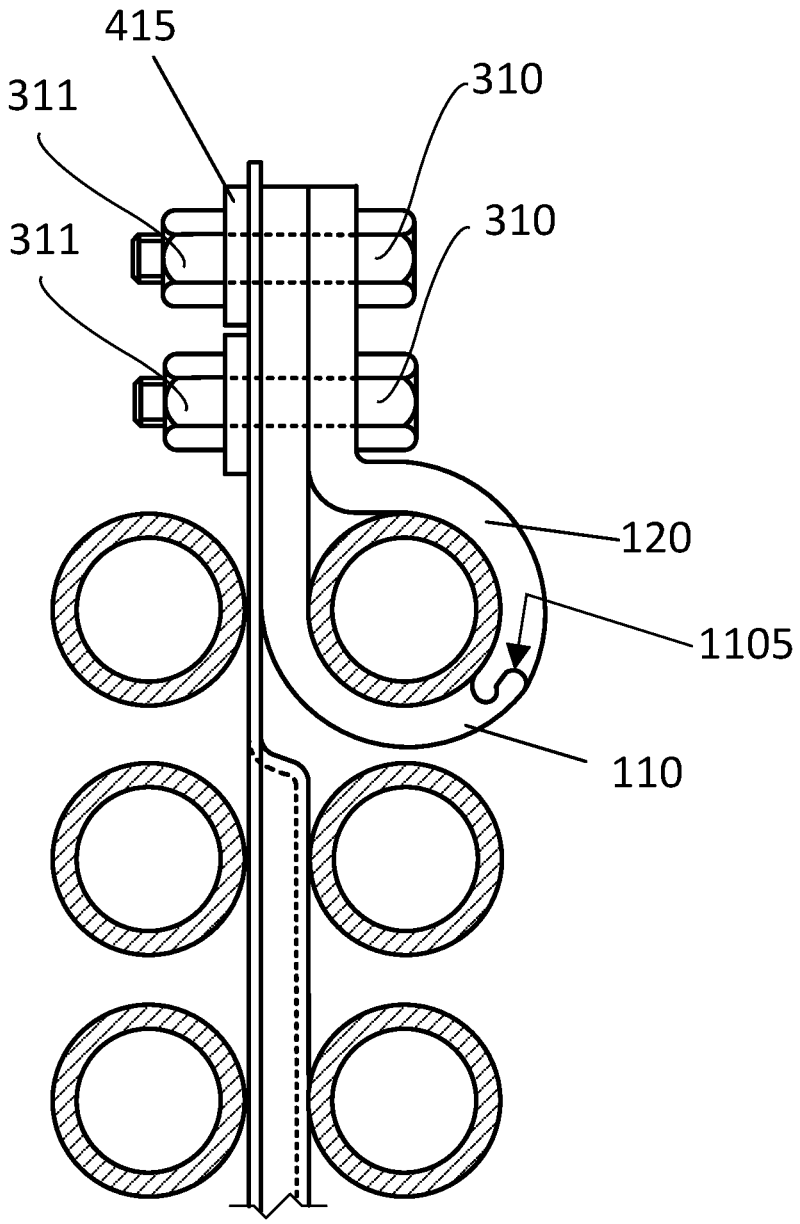
FIG. 11 is a side elevation view of an alternative embodiment of the clamping system for a tube in a tube bundle where the lower curved part of the first clamping component and the downward-curved section of the second clamping component meet and join together.

In an alternative preferred embodiment shown in FIG. 11, the first arc (210) of the J-shape (113) meets up with the second arc (220) of the L-shape (123). In this embodiment, the second arc (220) of the L-shape (123) is greater than 90 degrees of the tube (130) and the first arc (210) of the J-shape (113) is constrained to meet (1105) with the second arc so that the downward-curved section of the L-shape joins together with the lower curved part of the J-shape. The actual connection may be as shown or any other type connection that permits the curved sections to join together.

While shown in FIG. 11, the two nut and bolt means for securing is optional. This embodiment may not have two of the bolt (310), two of the nut (311) and two of the washer (505). The double-bolt arrangement adds more security to the connections. This alternative embodiment may utilize one of the nut (311), one of the bolt (310) and one or none of the washer (505).

Referring to FIG. 2, the clamping system is preferably configured so that the second arc (220) is constrained to be greater than about 10 degrees of the tube (130). Functionality involving a positive grip of the clamps to the tube (130) is retained with minus 2 degrees of the 10 degrees specified and so, for some applications, the second arc (220) is constrained to be greater than about 10 degrees of the tube (130).

As shown in FIG. 1A, the vertical-leg segment (121) of the L-shape (123) defines a second aperture (124) through the second clamping component (120). As shown in FIG. 2, the second aperture (124) is configured to align with the first aperture (114) when the second clamping component (120) is placed against the first clamping component (110) with the tube (130) between the first clamping component (110) and the second clamping component (120).

The clamping system further includes a means for resisting movement of the first clamping component (110) and the second clamping component (120) once the second clamping component (120) is placed against the first clamping component (110) with the tube between the first clamping component (110) and the second clamping component (120). These means for resisting movement are next explained in more detail.

In a first preferred embodiment, the means for resisting movement is a stake (330) that defines a third aperture (610). The third aperture (610) is configured to align with the first aperture (114) and the second aperture (124) when the second clamping component (120) is placed against the first clamping component (110) with the tube (130) between the first clamping component (110) and the second clamping component (120). This first preferred embodiment further includes a nut (311) and a bolt (310). The bolt (310) is configured to fit through the first aperture (114), the second aperture (124) and the third aperture (610) when the first aperture (114), the second aperture (124) and the third aperture (610) are placed in alignment. While the stake (330) and the second stake (430) may possess a unique configuration, as shown in the figures, it should be recognized that these stakes are exemplary of preferred stakes. Other stake designs are known. Any stake well known in the field may be used in lieu of the stake (330) and the second stake (430), shown in the figures.

Figure 3A:
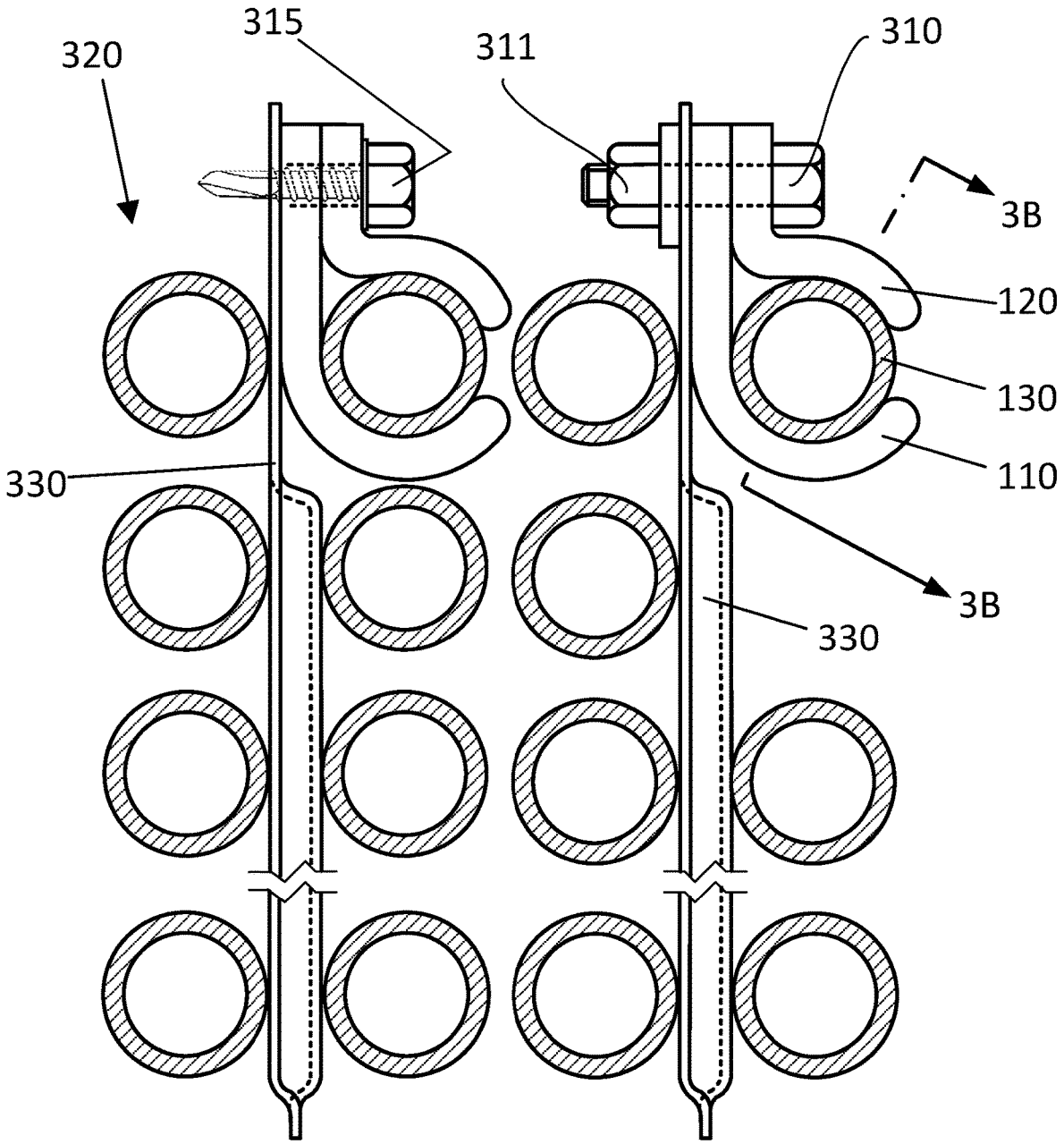
FIG. 3A is an elevation view of two embodiments of assembled clamping systems in the context of a tube bundle.
Figure 3B:
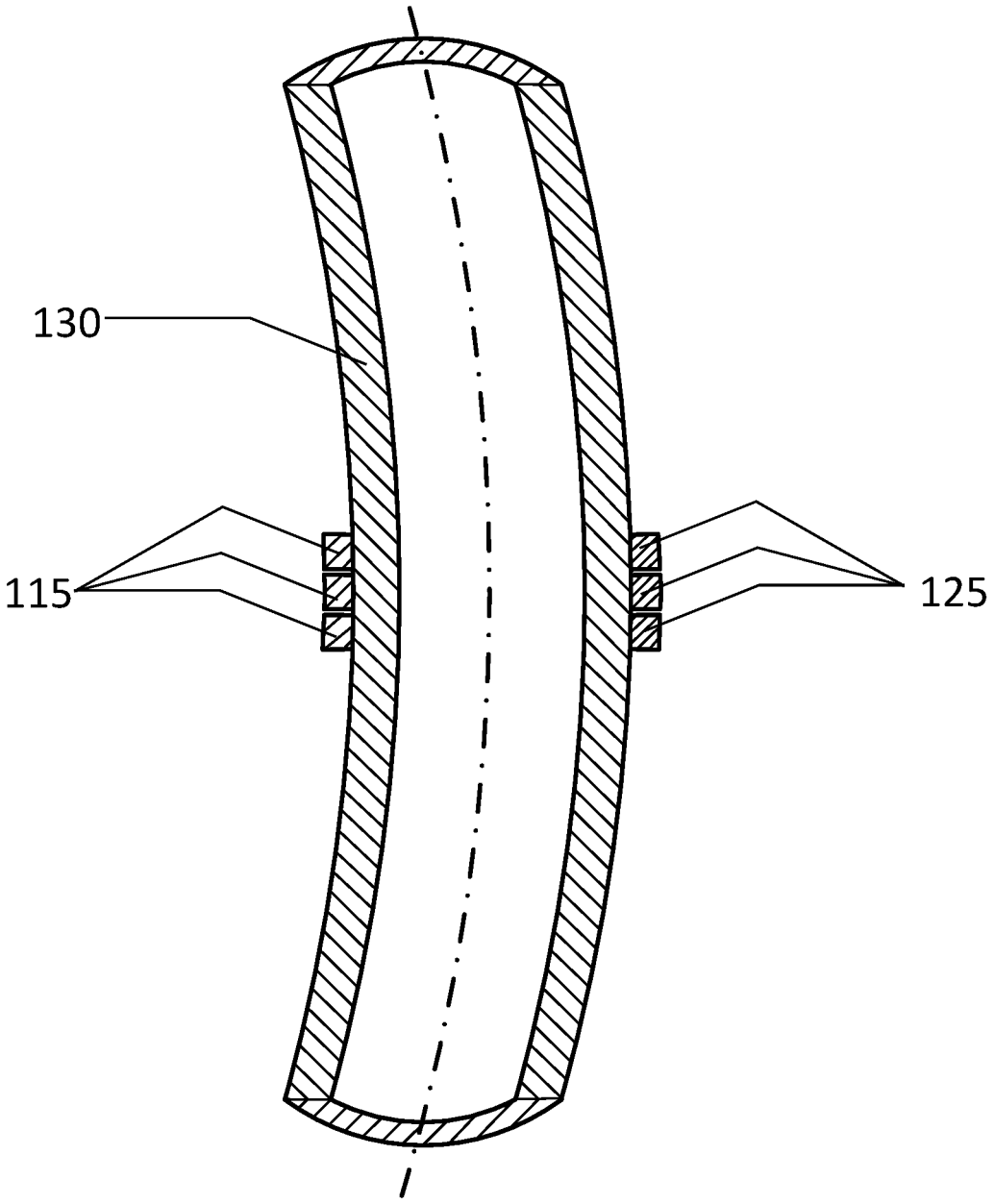
FIG. 3B is a sectional view at section 3B-3B of FIG. 3A showing about half of a tube and only the ends of first fingers of the J-shape and of second fingers of the L-shape.
Figure 4:
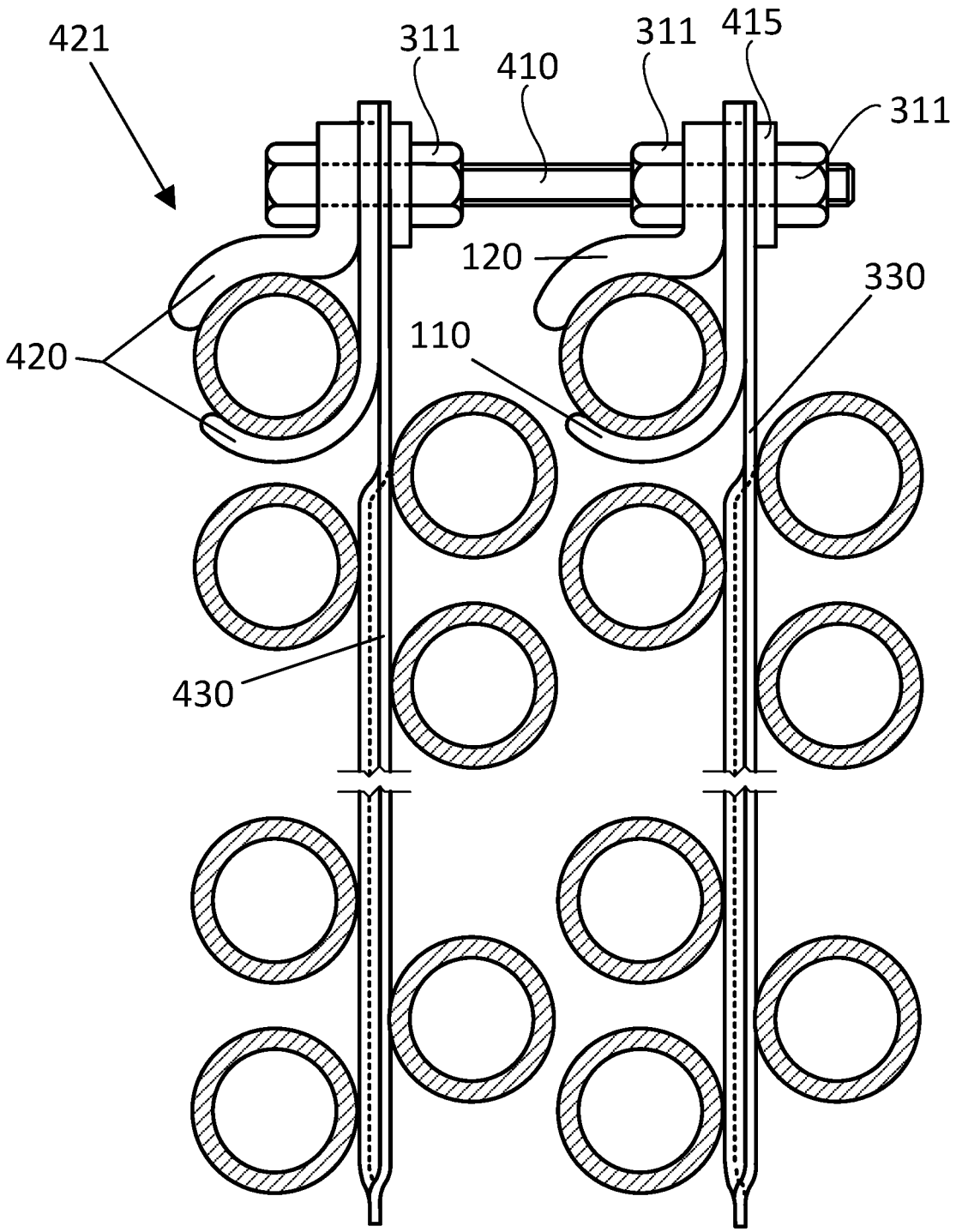
FIG. 4 is an elevation view of a triangular tube bundle with the tubes arranged in a triangular configuration and shown with a means for resisting movement that includes a long bolt.
Figure 6A:
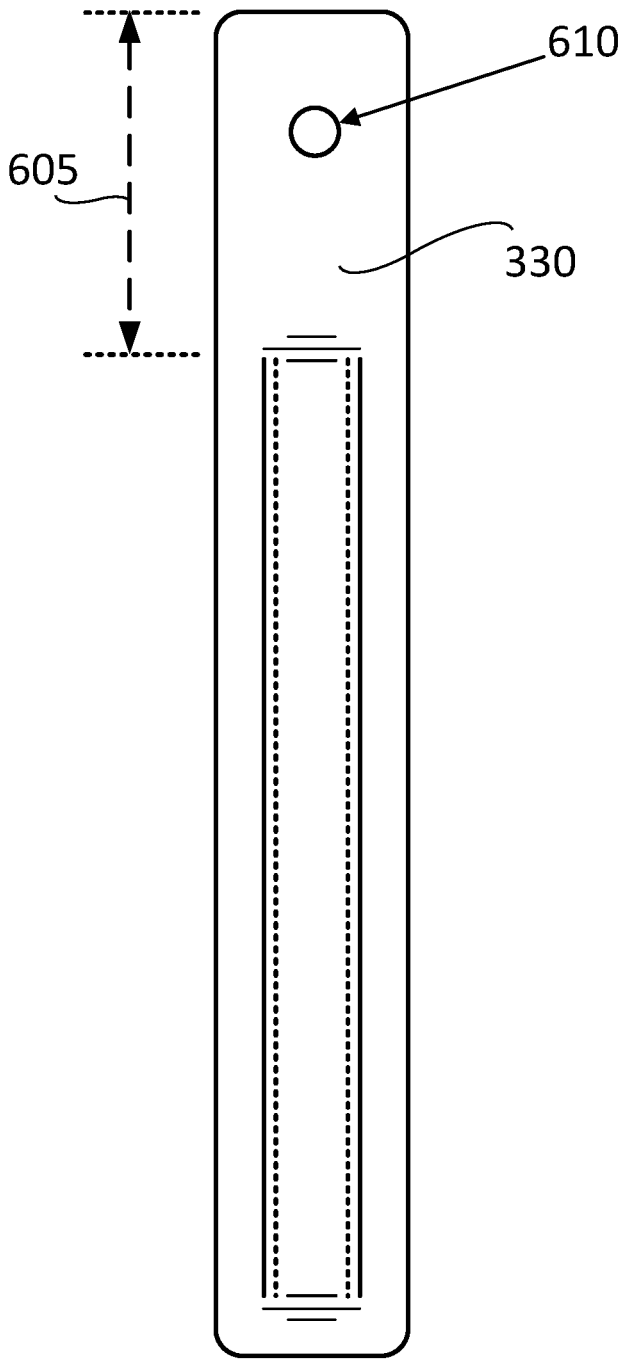
FIG. 6A is a front elevation view of a stake with a central channel and segments at the top and bottom that are flat.
Figure 6B:
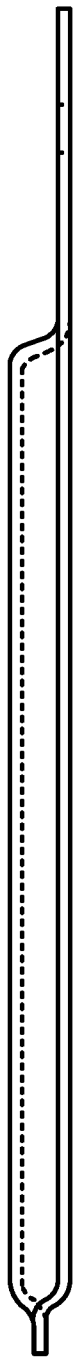
FIG. 6B is a side elevation view of the stake shown in FIG. 6A.
Figure 7A:
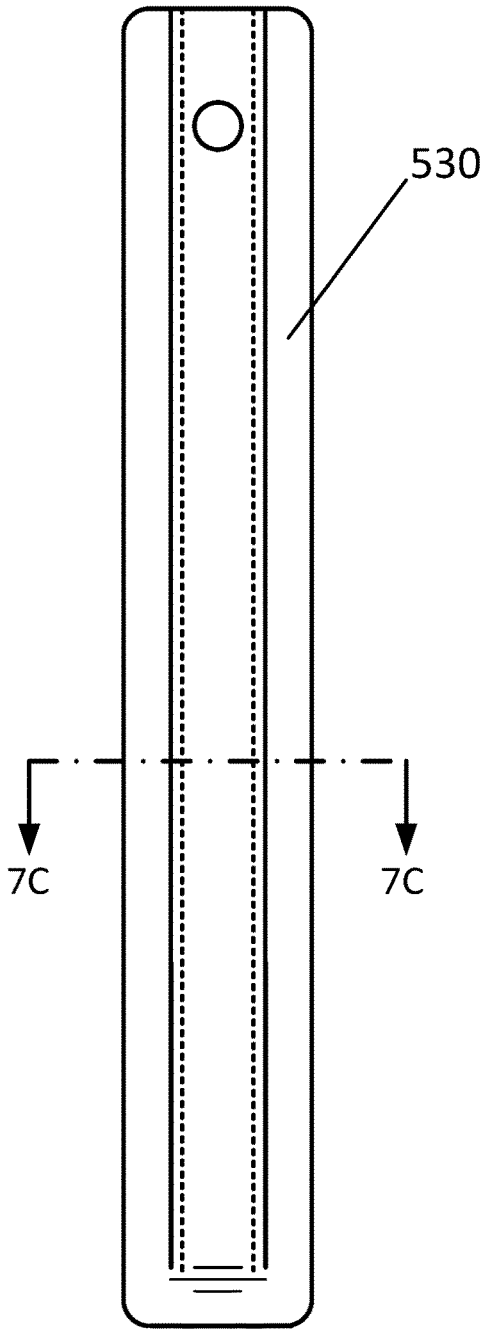
FIG. 7A is a front elevation view of the alternative stake shown in FIG. 5A with a central channel running from the top of the stake to a point near the bottom where it transitions to a flat segment.
Figure 7B:
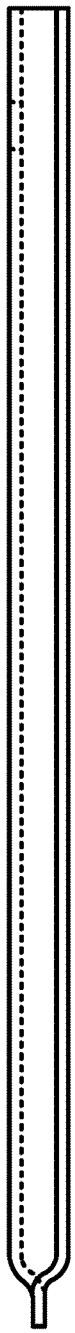
FIG. 7B is a side elevation view of the stake shown in FIG. 7A.
Figure 7C:
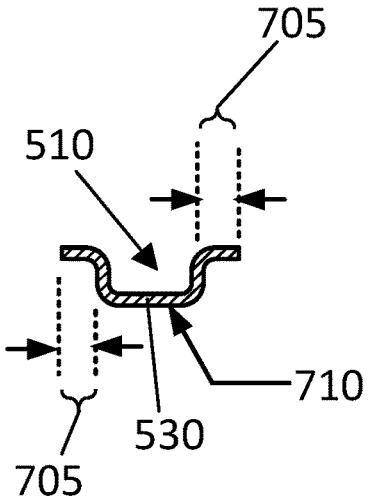
FIG. 7C is a sectional view at section 7C-7C of FIG. 7A.

The preferred stake is the stake (330) with an elongated channel (510), shown in FIG. 3A, FIG. 4 and FIG. 6. In this embodiment, the elongated channel (510) starts below the first row of tubes near the top of the stake (330) and extends downward until it passes a last tube (531) in the tube bundle (320). As in all the preferred embodiments of the stake, the elongated channel (510) is configured with extensions (705), best shown in FIG. 7. The extensions (705) are preferably nearly perpendicular to the side walls of the channel to provide an engagement surface against the tubes in a tube bundle (320). By "nearly perpendicular" it is meant that the side walls are best configured when they are slightly slanted to ease the pressing process (to avoid the pressed product from being getting stuck in a die set), and the preferred approach is that the extensions (705) should be approximately parallel to the central plane of the stake, i.e., the planar side (710).

Preferably, the stake (330) is wide enough so that a planar side (710) and the extensions (705) push against adjacent tubes in each row of the heat exchanger below the row having the two clamping components. When so configured, the stake (330) directly contacts and engages with each row below the first clamping component (110) and the second clamping component (120), also referred to herein as two clamping components, so as to inhibit tube vibration in the rows of tubes below these two clamping components. The flat part (605) of the stake near the top is one configuration to simplify attachment of the two clamping components to the stake (330). It is noted that the first tube on the right side of the stake (330) in FIG. 3A does not directly engage with, or is not directly pushed upon by, the stake (330) via the extensions (705) on the stake (330). However, it is noteworthy that engagement occurs as the flat part (605) of the stake (330) comes in contact with the first clamping component (110) on the right side of the stake (330) and the next adjacent tube to the left of the stake (330) bears against the left side of that stake. Thus, that next adjacent tube, in turn, pushes back on the stake (330) and the clamping system thereby indirectly pushes on the tube on the right side of the stake (330).

An alternative preferred embodiment of an alternative stake (530) is shown in FIG. 5A, FIG. 7A, FIG. 7B and FIG. 7C. The alternative stake (530) has an elongated channel (510) that extends from a top end of the stake to a point below the last tube in the tube bundle. In this embodiment, the first clamping component (110) is positioned within the elongated channel (510) prior to attachment to the alternative stake (530). Thus, the straight part (112) of the first clamping component (110) is configured to fit within the elongated channel (510).

The means for resisting movement may alternatively be a stake (330) and a self-tapping screw (315). The self-tapping screw (315) is configured to fit within the first aperture (114) and the second aperture (124) and pierce the stake (330) to secure the first clamping component (110) and a second clamping component (120) to the stake (330). Reference herein to the stake (330) is intended to include reference to the alternative stake (530) and to any other stake design that may be used when the context so permits. This embodiment with a self-tapping screw (315) is one where welding may be advisable as a backup means for resisting movement to ensure the self-tapping screw (315) does not loosen up and to have added security the clamping system will not move once installed.

A second set (420) of the first clamping component (110) and the second clamping component (120) may be added to any of the embodiment described herein, as shown in FIG. 4. This second set (420) is installed on a nearby tube, wherein the means for resisting movement comprises a second stake (430), three of the nut (311); and a long bolt (410), the long bolt (410) joining the two sets of clamping components together. Washers, including a lock washer (415), a washer (505), a separation washer (805) and a flexible washer (512) may be used with the nut (311) and the bolt (310) or the long bolt (410) in any of the embodiments described herein.

The means for resisting movement may alternatively be a stake (330) in combination with a self-tapping screw (315), shown in FIG. 3A. The self-tapping screw (315) is used to pierce the stake (330). In this embodiment, the stake may or may not also have a third aperture (610) to mate with the first aperture (114). When the third aperture (610) is smaller than the central bar of the self-tapping screw (315), the self-tapping screw (315) may also be utilized with the first aperture (114). Preferably, and in most applications where a self-tapping screw (315) is used, the self-tapping screw (315) would be utilized to pierce the stake (330) in a place other than through the first aperture (114), so as to physically engage and draw the stake (330) to the first clamping component (110) and the second clamping component (120).

Figure 8:
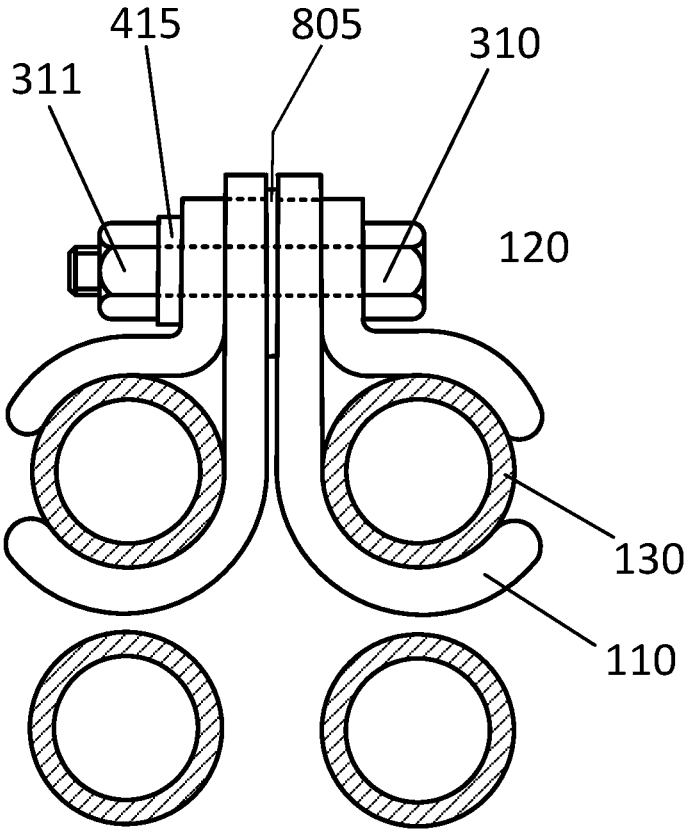
FIG. 8 shows a means for resisting movement that includes two abutting J-shapes and two L-shapes connected with a nut and bolt.

As shown in FIG. 8, the means for resisting movement may alternatively be back to back sets of the two clamping components in which each set including the first clamping component (110) and the second clamping component (120) where the aperture in the four clamping components align so that a nut and bolt connects the four clamping components together. In assembly, these two sets of clamping components have J-shapes that abut each other, back to back. This embodiment is most suitable for a tube bundle (320) where the tubes are immediately adjacent to each other as shown in FIG. 3A. A separation washer (805) may be used to enable insertion of a stake (330) in the tube bundle after tightening the nut (311) and bolt (310).

For a triangular tube bundle (421) where one row of tubes is above or below the adjacent tube row, FIG. 4 illustrates combining two sets of clamping components with a long bolt (410) and at least three nuts, each designated as nut (311) in FIG. 4. For this embodiment, the means for resisting movement first comprises a first stake, shown as the stake (330) in FIG. 4, which is inserted between two nearby tube rows. This means for resisting movement next comprises a second stake (430), which is inserted between two other nearby or adjacent tube rows, shown on the left in FIG. 4. Preferably, when two or more stakes are inserted, one lane is skipped. A plurality of stakes may be used in a similar manner. For some installations, the long bolt (410) may be elastically deformed to aid in installation, for example, in the regions between any two adjacent clamping systems. Such slight bending is also beneficial because it increases overall stiffness and thereby adds to the positional integrity of the entire clamping system.

This means for resisting movement next comprises a second set (420) of the first clamping component and the second clamping component, the second set (420) installed on one of the tubes in the two other nearby tube rows. This means for resisting movement is further limited to the configuration wherein both sets of first clamping components and second clamping components are joined together with at least three nuts on the long bolt (410). As intended by the transitional phrase "comprises," additional nuts may be added to back up these three nuts and provide greater security against any nut (311) loosening up. This configuration is shown in FIG. 4 wherein there are three of the nut (311) and the long bolt (410). While not illustrated, this arrangement could also be used for an inline tube arrangement because having tubes at the same level is not essential.

It is intended that the means for resisting movement may alternatively include clamping components that are either directly welded together, welded to a member like the bolt (310), the long bolt (410), the stake (330), or welded in addition to the use of one or more nuts with one or more bolts. The welding process optionally replaces the need for threaded attachments using one or more nuts with a bolt, or increases safety by adding another physical engagement that resists movement. Thus, one means for resisting movement comprises a stake (330) inserted between two adjacent tube rows; and a weld (230) joining the first clamping component (110) and the second clamping component (120) to the stake.

Figure 1C:
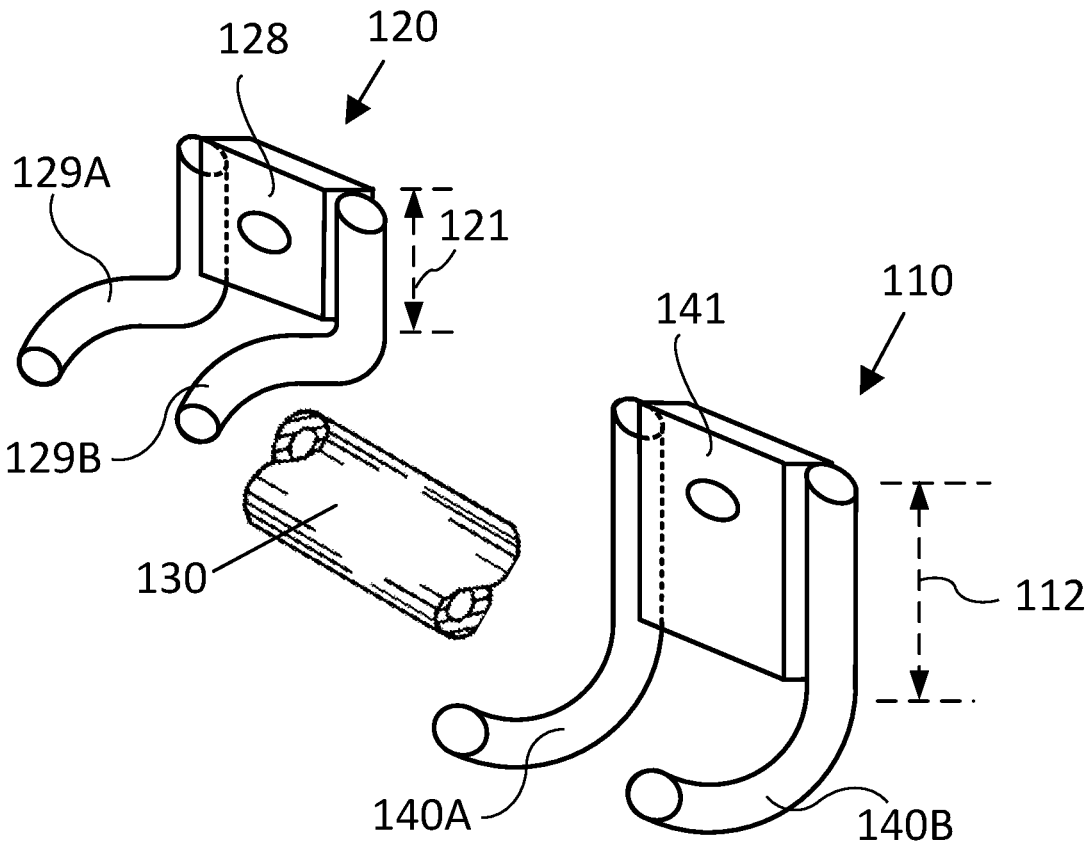
FIG. 1C is a perspective view of an alternative embodiment of the first clamping component in a J-shape and an alternative embodiment of the second clamping component in an L-shape showing the tube in context.

In this example, the clamping components are fabricated by welding curved rods or tubular ends to a flat plate. First tubular ends (140A) and (140B) for the J-shape and second tubular ends (129A) and (129B) for the L-shape are shown in FIG. 1C. This arrangement creates the J-shape (113) and the L-shape (123) clamps using a flat plate. For example, the vertical-leg segment (121) would comprise a rectangular piece of metal and two rods would be welded on the two thin sides of the rectangular piece; making the curved part on the rods, which may be completed before or after welding.

In the alternative embodiment shown in FIG. 1C, the first clamping component (110) configured with a J-shape (113) comprises first tubular ends (140A) and (140B) connected by a first plate (141) welded to the first tubular ends (140A) and (140B) at the straight part (112) of the J-shape (113); and the second clamping component (120) configured with an L-shape (123) comprises second tubular ends (129A) and (129B) connected by a second plate (128) that is welded to the second tubular ends (129A) and (129B) at the vertical-leg segment (121) of the L-shape (123). The term "tubular ends" is intended to describe any rod shape, for example including a rod having a solid core.

Figure 10:
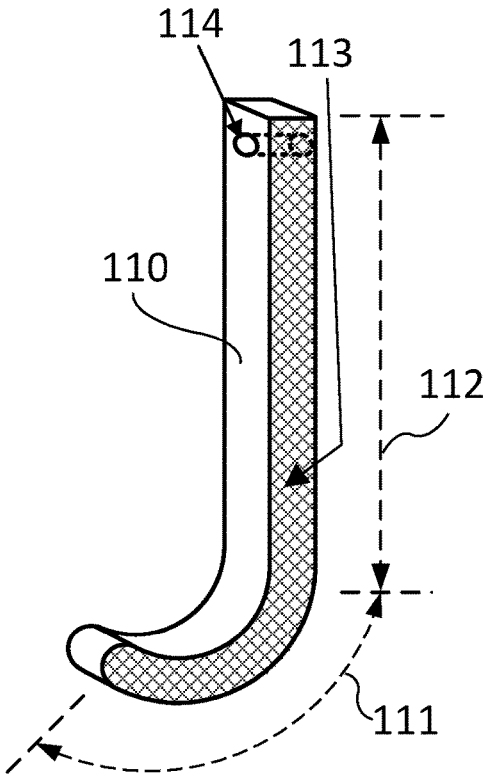
FIG. 10 is a perspective view of a possible narrow configuration of the J-shape of FIG. 9.

In other embodiments, the first clamping component (110) with the J-shape (113) shown in FIG. 10 may be combined with the second clamping component (120) with the L-shape (123) shown in FIG. 1C so that there are essentially three points of contact with the tube (130). Essentially, first clamping component (110) with the J-shape (113) acts as a single member and the middle finger of the second fingers (125) in the second clamping component (120) with the L-shape (123) is removed. Thus, in this embodiment, the first clamping component (110) is configured with a narrow width as in FIG. 10 and is either long to fit two or more tubes or is short to fit on one tube. Further, in this embodiment, the second clamping component (120) configured with an L-shape comprises second tubular ends, i.e. with the second fingers (125) modified to have two outer fingers and no middle finger. The two outer fingers, i.e. the second tubular ends (129A) and (129B) are connected by a second plate (128) welded to the second tubular ends (129A) and (129B), as shown in FIG. 1C. The second plate (128) serving to separate the second tubular ends (129A) and (129B) and to complete the vertical-leg segment (121) of the L-shape (123). Finally, in this embodiment, the horizontal-leg segment of the L-shape (123) is formed by the second tubular ends (129A) and (129B).

Figure 5A:
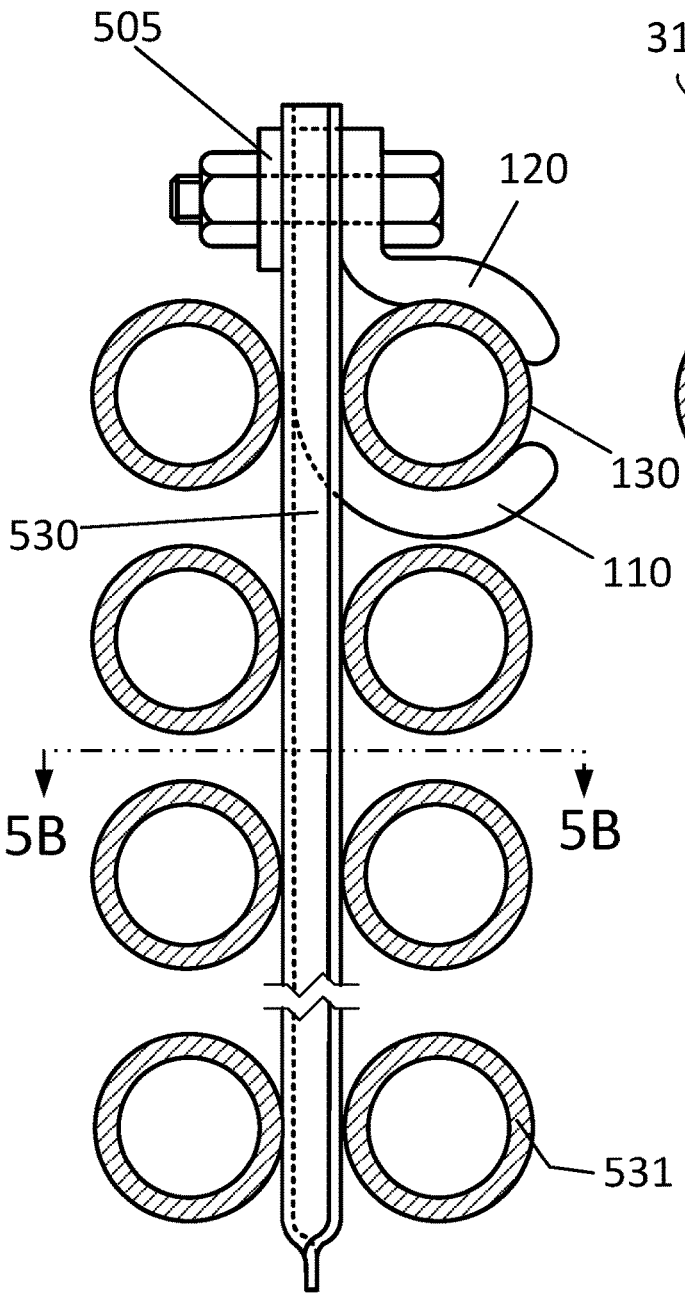
FIG. 5A is an elevation view of a tube bundle showing an alternative or second stake where the central channel runs from top to a point near the bottom where it transitions to a flat segment and where the J-shape fits within the central channel.
Figure 5C:
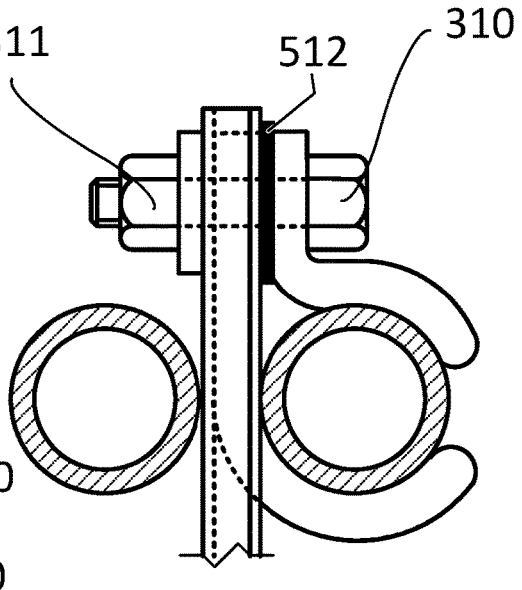
FIG. 5C is an elevation view of two tubes, the alternate stake and an assembled clamping system where the J-shape fits within the central channel of the alternative stake.
Figure 5B:
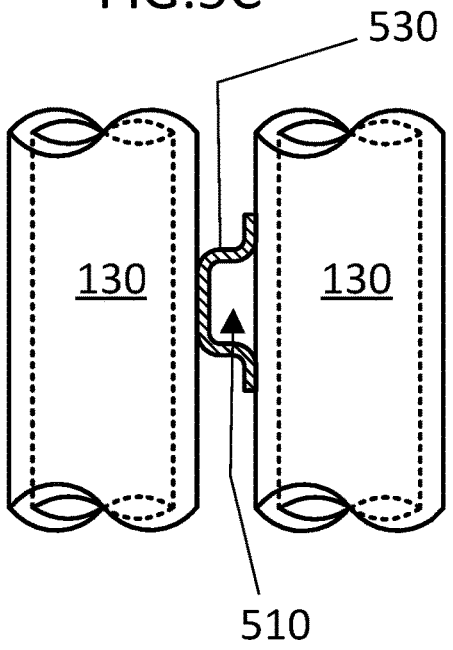
FIG. 5B is a sectional view at section 5B-5B of FIG. 5A showing a top view of the alternative stake within two tubes.

Referring to FIG. 5C, the clamping system may further include a flexible washer (512) having a thickness within a range of 0.2 to 3 millimeters. Preferably, the flexible washer (512) is configured to occupy a position between the second clamping component (120) and the first clamping component (110). The flexible washer (512) preferably occupies what would otherwise be a "gap" that assists in assembly of the first clamping component (110) and the second clamping component (120) to create a desired stress on the tube (130) once the nut (311) and bolt (310) are tightened.

The two curved parts and the two vertical parts, i.e., the straight part (112) of the first clamping component (110) and the vertical-leg segment (121) of the second clamping component (120), are preferably precision-made using die sets with tight tolerances or by an extrusion process with adequate tolerances. When all pieces are manually assembled and pushed to their respective tightened positions, the presence of this flexible washer (512), or the presence of the gap if the washer is not present, is the means with which reactive forces are created between five members: The first clamping component (110), the second clamping component (120), the tube (130), the nut (311), and the bolt (310).

Figure 9:
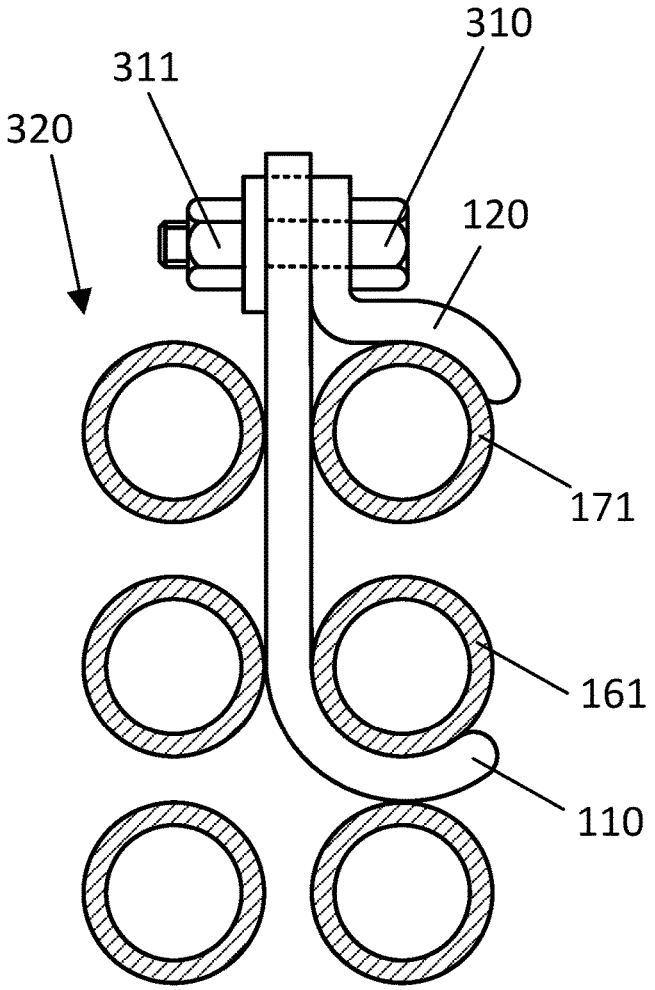
FIG. 9 is a side elevation view of an alternative clamping system having an extended J-shape and linking two tubes in a tube bundle.

FIG. 9 is a side elevation view of an alternative clamping system having an extended J-shape and linking two tubes in a tube bundle. Preferably, no stake (330) is used in this embodiment. With this embodiment, the first clamping component (110) with the J-shape also engages with tubes to the left as well with the tubes it engages with the first arc (210). The extended J-shape may be lengthened to extend downward to the last row of tubes and thus also serve the same purpose as a stake for the tubes below the tube engaging with the second arc (220) and above the tube engaging with the first arc (210) of the clamping system.

For this embodiment, the first arc (210) is preferably defined to be greater than 30 degrees of the first tube (161). If the first clamping component (110) with the extended J-shape has a thickness of about ¼", which is the typical thickness for an inline arrangement of tubes, then this 30-degree angle is practical. For the staggered arrangement of tubes, the thickness is typically only about ⅛" and, therefore, would probably not be sufficiently sturdy. So, for the staggered arrangement, the angle would preferably be greater than 90 degrees of the first tube. As with the other preferred embodiments, the straight part (112) of the first clamping component (110) with an extended J-shape defines a first aperture (114) through the first clamping component (110). Preferably, the second arc (220) of the second clamping component (120) with the L-shape (123) is greater than about 10 degrees of the second tube (171).

The first clamping component (110) of the FIG. 9 embodiment may be narrowed as shown in FIG. 10 so that the J-shape can be rotated by 90 degrees for insertion into the tube bundle (320). This would enable the first clamping component (110) to extend downward to reach the tube that it will engage with the first arc (210). Once at that position, the first clamping component (110) would then be rotated into place in the correct orientation so that the first arc (210) can engage with the tube. The tubes at that location may have to be pulled or pushed apart to enable this rotation to the correct orientation. It is anticipated that this embodiment would be most suitable for small tube bundles, e.g. tube bundles with 6 to 8 rows of tubes. For larger bundles, the stake is preferably included. When the tube bundle is deep, a 90-degree rotation could lead to torsion within the J-clamp due to an outer end rotating while no rotation takes place at all at an inner end.

The above-described embodiments including the drawings are examples of the invention and merely provide illustrations of the clamping system for a tube in a tube bundle. Other embodiments will be obvious to those skilled in the art. Thus, the scope of the invention is determined by the appended claims and their legal equivalents rather than by the examples given.

INDUSTRIAL APPLICABILITY

The invention has application to the heat exchanger industry.

What is claimed is:

1. A clamping system for a tube in a tube bundle, the clamping system comprising a first clamping component; a second clamping component, the first clamping component configured with a J-shape and comprising a lower curved part and a straight part, the lower curved part of the J-shape configured to occupy a first arc around a segment of a tube in the tube bundle, the first arc defined to be greater than 10 degrees of the tube, the straight part of the J-shape defining a first aperture through the first clamping component;

a second clamping component configured with an L-shape and comprising a horizontal-leg segment and a vertical-leg segment, the horizontal-leg segment of the L-shape has a downward-curved section configured to occupy a second arc opposite to the first clamping component, the second arc defined to be greater than 10 degrees of the tube, the vertical-leg segment of the L-shape configured to fit against the straight part of the J-shape of the first clamping component, the vertical-leg segment of the L-shape defining a second aperture through the second clamping component, the second aperture configured to align with the first aperture when the second clamping component is placed against the first clamping component with the tube between the first clamping component and the second clamping component;

wherein the first arc around the tube plus the second arc around the tube is equal to at least 100 degrees; and the clamping system further comprising a means for resisting movement of the first clamping component and the second clamping component on the tube once the second clamping component is placed against the first clamping component with the tube between the first clamping component and the second clamping component.

2. The clamping system of claim 1, wherein the means for resisting movement comprises a stake defining a third aperture; a nut; and a bolt, the bolt configured to fit through the first aperture, the second aperture and the third aperture when the first aperture, the second aperture and the third aperture are placed in alignment.

3. The clamping system of claim 1, wherein the means for resisting movement comprises a stake configured with an elongated channel and having a planar side and an open side with two extensions, the stake defining a third aperture configured to align with the first aperture and the second aperture when the second clamping component is placed against the first clamping component with the tube between the first clamping component and the second clamping component; a bolt that fits through the aligned apertures; and a nut that is threadably attachable to the bolt.

4. The clamping system of claim 3, wherein the straight part of the first clamping component is configured to fit within the elongated channel.

5. The clamping system of claim 1, wherein the means for resisting movement comprises:

a first stake inserted between two adjacent tube rows;

a second stake inserted between two other adjacent tube rows;

a second set of the first clamping component and the second clamping component, the second set installed on one of the tubes in the two other adjacent tube rows; and wherein both sets of first clamping components and second clamping components are joined together with at least three nuts and a long bolt.

6. The clamping system of claim 1, wherein the means for resisting movement comprises a stake inserted between two adjacent tube rows; and a weld joining the first clamping component and the second clamping component to the stake.

7. The clamping system of claim 1, wherein the means for resisting movement comprises a stake and a self-tapping screw, the self-tapping screw configured to fit within the first aperture and the second aperture and pierce the stake to secure the first clamping component and a second clamping component to the stake.

8. The clamping system of claim 1, wherein the first arc is constrained to extend to a range of 10 to 135 degrees of the tube and the second arc is constrained to extend to a range of 30 to 75 degrees of the tube.

9. The clamping system of claim 1, wherein the first arc is constrained to extend to a range of 10 to 135 degrees of the tube and the second arc is constrained to extend to a range of 10 to 135 degrees of the tube.

10. The clamping system of claim 1, wherein the second arc of the L-shape is greater than 90 degrees of the tube and the first arc of the J-shape is constrained to meet with the second arc so that the downward-curved section of the L-shape joins together with the lower curved part of the J-shape.

11. The clamping system of claim 1, further comprising a flexible washer having a thickness within a range of 0.2 to 3 millimeters, and configured to occupy a position between the second clamping component and the first clamping component.

12. The clamping system of claim 1, wherein the lower curved part of the J-shape is further configured to define first fingers made flexible by one or more first cuts defined within the lower curved part of the J-shape.

13. The clamping system of claim 1, wherein the horizontal-leg segment of the L-shape is further configured to define second fingers made flexible by one or more second cuts defined within the horizontal-leg segment of the L-shape.

14. The clamping system of claim 1, wherein:

the first clamping component configured with a J-shape comprises first tubular ends connected by a first plate welded to the first tubular ends at the straight part of the J-shape; and the second clamping component configured with an L-shape further comprises second tubular ends connected by a second plate welded to the second tubular ends at the vertical-leg segment of the L-shape.

15. The clamping system of claim 1, wherein:

the second clamping component configured with an L-shape comprises second tubular ends connected by a second plate welded to the second tubular ends at the vertical-leg segment of the L-shape; and the horizontal-leg segment is formed by the second tubular ends.

16. A clamping system for one or more tubes in a tube bundle, the clamping system comprising a first clamping component; a second clamping component, the first clamping component configured with a J-shape and comprising a lower curved part and a straight part, the lower curved part of the J-shape configured to occupy a first arc around a segment of a first tube in the tube bundle, the first arc defined to be greater than 30 degrees of the first tube, the straight part of the J-shape defining a first aperture through the first clamping component;

a second clamping component configured with an L-shape and comprising a horizontal-leg segment and a vertical-leg segment, the horizontal-leg segment of the L-shape has a downward-curved section configured to occupy a second arc defined to be greater than 10 degrees of a second tube, the vertical-leg segment of the L-shape configured to fit against the straight part of the J-shape of the first clamping component, the vertical-leg segment of the L-shape defining a second aperture through the second clamping component, the second aperture configured to align with the first aperture when the second clamping component is placed against the first clamping component on the first tube and the second clamping component on the second tube; and the clamping system further comprising a means for resisting movement of the first clamping component on the first tube and the second clamping component on the second tube once the second clamping component is placed against the first clamping component with the first tube engaged with the first clamping component and the second tube engaged with the second clamping component.

* * * * *